US005412403A

United States Patent [19]

Nishizawa et al.

[11] Patent Number: 5,412,403

[45] Date of Patent: May 2, 1995

[54] VIDEO DISPLAY CONTROL CIRCUIT

[75] Inventors: Kazuyuki Nishizawa; Kazuhide Kawata, both of Tokyo, Japan

[73] Assignee: NEC Corporation, Japan

[21] Appl. No.: 116,044

[22] Filed: Sep. 2, 1993

Related U.S. Application Data

[63] Continuation of Ser. No. 702,063, May 17, 1991, abandoned.

[30] Foreign Application Priority Data

May 17, 1990 [JP] Japan ..... 2-128052

[51] Int. Cl.[6] ..... G09G 1/14

[52] U.S. Cl. ..... 345/192; 345/193

[58] Field of Search ..... 345/192, 193, 194, 185, 345/200, 203, 196, 197; 365/189.01, 189.04, 189.05

[56] References Cited

U.S. PATENT DOCUMENTS

| | | | |
|---|---|---|---|
| 4,388,621 | 6/1983 | Komatsu et al. | 340/750 |
| 4,604,615 | 8/1986 | Funahashi | 340/750 |
| 4,677,432 | 6/1987 | Maeda et al. | 340/750 |
| 4,757,312 | 7/1988 | Asai et al. | 340/750 |
| 4,891,788 | 1/1990 | Kreifels | 365/189.01 |
| 4,897,637 | 1/1990 | Kobayashi et al. | 340/750 |
| 5,062,081 | 10/1991 | Runaldue | 365/189.04 |
| 5,247,485 | 9/1993 | Ide | 365/189.04 |

*Primary Examiner*—Ulysses Weldon
*Assistant Examiner*—Xiao M. Wu
*Attorney, Agent, or Firm*—Whitham, Curtis, Whitham & McGinn

[57] ABSTRACT

A video display control circuit includes a reading circuit for reading address data in a video RAM pointer. The video RAM pointer designates an address in a RAM where an address data to be supplied to a character ROM pointer is stored. The character ROM pointer designates an address in a ROM where character data by which characters are displayed on a screen are stored. If the address data read from the video RAM pointer is earlier in access time than a selected address of the video RAM, into which a new address data is required to be re-written, operation of re-writing data of the video RAM is not carried out, so that flickering or momentary black-out of the display caused by the re-writing operation may not occur.

5 Claims, 6 Drawing Sheets

VIDEO DISPLAY CONTROL CIRCUIT

CROSS-REFERENCE TO RELATED APPLICATION

This is a continuation of application Ser. No. 07/702,063, filed May 17, 1993, now abandoned.

FIELD OF THE INVENTION

This invention relates to a video display control circuit, and more particularly to, a video display control circuit used in a scanning type video display apparatus such as a television set in which symbolic patterns or characters are displayed on a screen thereof.

BACKGROUND OF THE INVENTION

The conventional video display control circuit comprises a central processor unit (CPU) for controlling operation of the circuit, a character read only memory (C-ROM) for storing data of characters to be displayed, a display control signal generating circuit for generating a display control signal in accordance with data of characters supplied from the C-ROM, a C-ROM pointer for designating an address of the C-ROM where a character to be displayed is stored, a video random access memory (V-RAM) for storing addresses of the C-ROM by which the C-ROM pointer designates an address of the C-ROM, and a V-RAM pointer for designating an address of the V-RAM where an address data to be supplied to the C-ROM pointer is stored.

In operation, the V-RAM pointer designates an address of the V-RAM which is determined by a scanning position of the screen, so that a starting address of a character to be displayed is read from the V-RAM to be supplied to the C-ROM pointer. Then, the character data are read from the C-ROM which is accessed by the C-ROM pointer providing the starting address and increased addresses, and are supplied to the display control signal generating circuit, so that the character is displayed on the screen of the television set.

In this video display control by use of the CPU, data are re-written into the V-RAM during horizontal and/or vertical blanking retrace intervals to suppress the collision between the read-out of the V-RAM data and the re-writing of data into the after the finish of each scanning line display and/or each frame display.

According to the conventional video display control circuit, however, there is a disadvantage in that flickering or momentary black-out of the display may occur, because the re-writing operation does not finish during the vertical blanking retrace interval when a great amount of V-RAM data are re-written under the situation where operation other than the V-RAM data re-written is carried out during the limited interval. In order to overcome this disadvantage, another conventional video display control circuit has two V-RAMs which are used alternately for reading and writing, such that data are written one of tile V-RAMs while data are written into the other V-RAM. However, such a hardware structure has a disadvantage in cost.

SUMMARY OF THE INVENTION

Accordingly, it is an object of the invention to provide a video display control circuit in which flickering or momentary black-out of a display caused by re-writing operation does not occur without increasing cost thereof.

According to a feature of the invention, a video display control circuit comprises:

a first memory for storing first data relating to characters or symbolic patterns;

a second memory for storing second data relating to addresses of the first memory; and means for controlling the second memory to supply the second data to the first memory, from which the first data is read, the characters or the symbolic patterns being displayed in accordance with the read first data on a screen;

wherein the second memory is re-written with new second data into a selected address of the second memory by the controlling means, when a time difference for avoiding any collision between re-writing of the new second data into the selected address of the second memory and reading of the second data from the selected address of the second memory is detected by the controlling means.

BRIEF DESCRIPTION OF THE DRAWINGS

The invention will be explained in more detail conjunction with appended drawings wherein.

DESCRIPTION OF THE PREFERRED EMBODIMENTS

Before describing a video display control circuit in a preferred embodiment according to the invention, the conventional video display control circuit briefly described before will be explained in conjunction with FIGS. 1 to 3.

Figure 1:
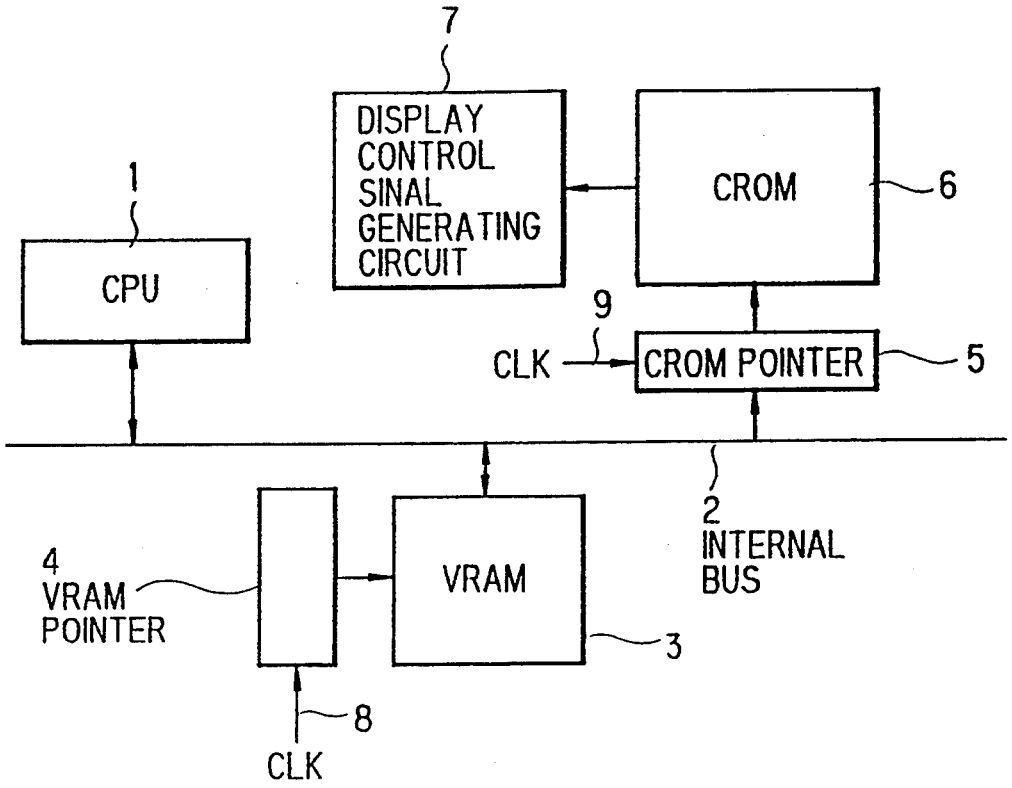
FIG.1 PRIOR ART
FIG. 1 is a block diagram of a conventional video display control circuit.

FIG. 1 is a block diagram of a conventional video display control circuit.

The conventional video display control circuit comprises a CPU 1 for controlling operation of the circuit, a C-ROM 6 for storing data of characters to be displayed, a display control signal generating in circuit 7 for generating a display control signal in accordance with character data supplied from the C-ROM 6, a C-ROM pointer 5 for designating an addresses where character data to be supplied to the display control signal generating circuit 7 is stored, a V-RAM 3 for storing address data to be supplied to the C-ROM pointer 5, and a pointer 4 for designating an address where an address data to be supplied to the C-ROM pointer 5 i s stored. The CPU 1, the C-ROM pointer 5 and the V-RAM 3 are connected each other by an internal bus 2.

In the data reading and transferring operation, the V-RAM pointer 4 designates an address at which an address data is stored in the V-RAM 3. In each horizontal scanning line, the start of scanning the V-RAM 3 by the V-RAM pointer 4 is synchronized with the horizontal synchronizing signal of the television set, and the V-RAM pointer 4 is increased to generate an address signal of the V-RAM 3 by receiving a clock signal 8, so that address data of the C-ROM 6 is read from the V-RAM 3. The address data read from the V-RAM 3 is transferred to the C-ROM pointer 5 through the internal bus 2. The C-ROM pointer 5 designates an address in the C-ROM 6 in accordance with the address data transferred from the V-RAM 3. The address data transferred from the V-RAM 3 is a starting address for a character data, and the C-ROM pointer 5 is increased to generate addresses of the character data based on the starting address by receiving a clock signal 9. The C-ROM 6 supplies the display control signal generating circuit 7 with the character data, so that the display control signal generating circuit 7 generates a display control signal by which a predetermined symbol pattern or character is displayed on the screen of the television set.

As described above, the V-RAM 3 is accessed in accordance with a scanning position of the screen by the V-RAM pointer 4, so that character data are sequentially supplied from the C-ROM 6 which is accessed by the C-ROM pointer 5 receiving the V-RAM data to the display control signal generating circuit 7. Thus, characters defined by the character data supplied from the C-ROM 6 are displayed on the screen in the order determined by a program stored in a program ROM (not shown). The video display is completed for one frame by scanning whole horizontal lines on the screen, and the following video display starts for the next frame by a vertical synchronizing signal. In this video display control by use of the CPU 1, data of the V-RAM 3 are re-written during horizontal and/or vertical blanking retrace intervals as instructed by the program.

Figure 2:
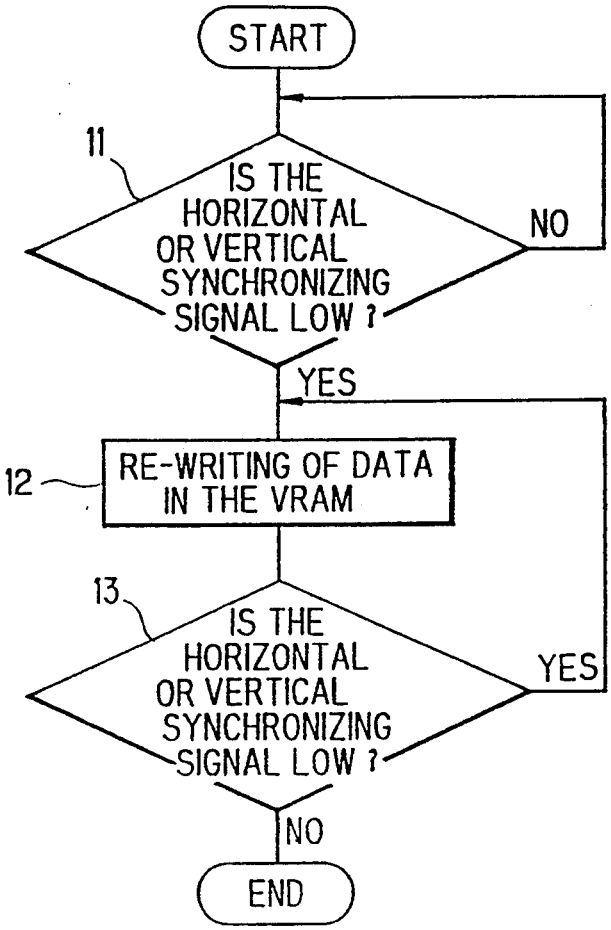
FIG.2 PRIOR ART
FIG. 2 is a flow chart explaining operation of the conventional video display control circuit.

FIG. 2 is a flow chart explaining operation of the conventional video display control circuit.

In re-writing operation, address data corresponding to one horizontal line or one frame to be displayed next are written into the V-RAM 3 during the horizontal blanking retrace interval (which is 10.8 μs in NTSC system), during which a horizontal synchronizing signal is active, or the vertical blanking retrace interval (which is 539.75 μs in NTSC system), during which a vertical synchronizing signal is active, to avoid flickering of the display caused by the re-writing operation collided with the reading of the V-RAM data. In the re-writing operation, a level of the horizontal or vertical synchronizing signal is checked at a step 11 as shown in FIG. 2. If the synchronizing signal is low (active), then address data are written into the V-RAM 3 at a step 12. If the synchronizing signal is high, then the control of the CPU 1 re-starts from the step 11 after a some waiting time. After that, a level of the horizontal or vertical synchronizing signal is checked again at a step 13. If the synchronizing signal is low, the control of the step 12 is carried out again by the CPU 1. If the synchronizing signal is high, the operation ends.

Figure 3:
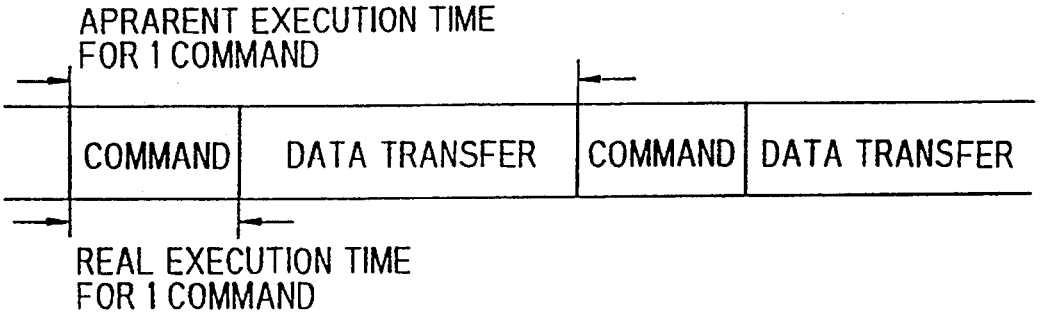
FIG.3 PRIOR ART
FIG. 3 is an explanatory diagram of command execution cycles of the conventional video display control circuit.

FIG. 3 is an explanatory diagram of command execution cycles of the conventional video display control circuit. In the video display control circuit, the address data or the character data are transferred through the internal bus 2 during a data transfer period, after the CPU 1 executed a command.

Therefore, the apparent execution time which includes the data transfer becomes longer, although the real execution time for one command is not so long.

Figure 4:
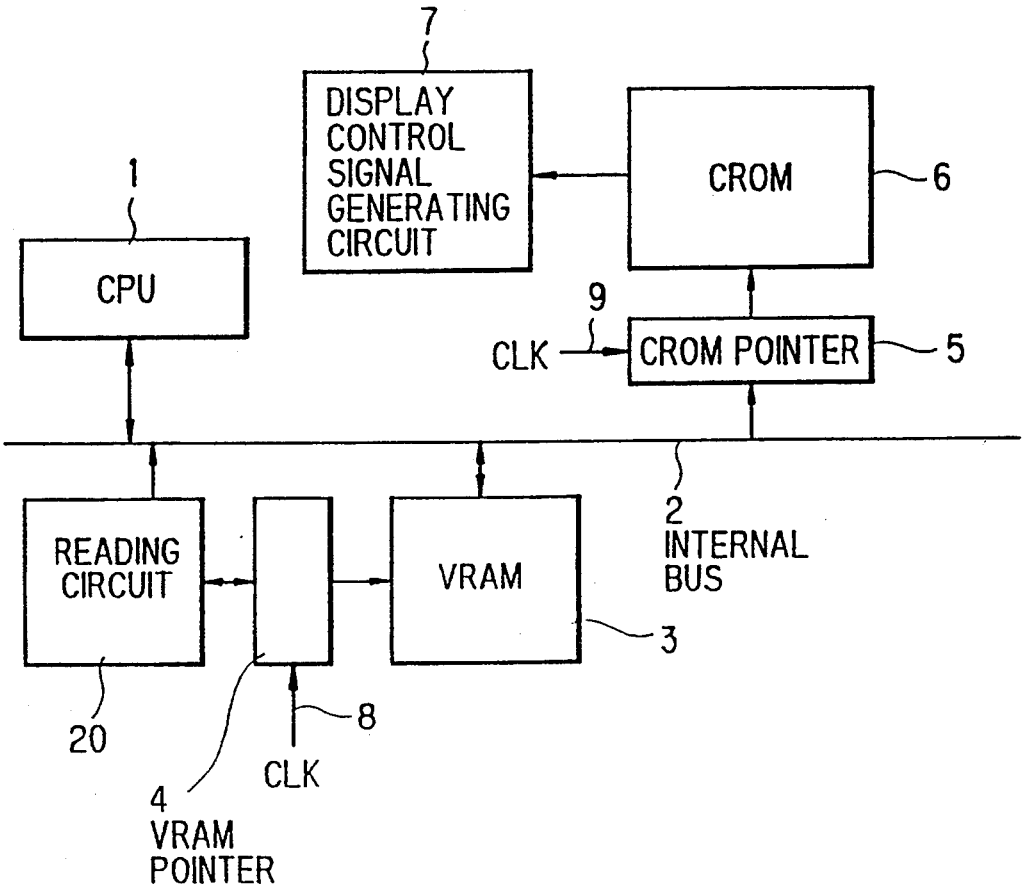
FIG. 4 is a block diagram of a video display control circuit in a preferred embodiment according to the invention.

Next, FIG. 4 is a block diagram of a video display control circuit in a preferred embodiment according to the invention. In the video display control circuit in the preferred embodiment, the basic structure is the same as that of the conventional video display control circuit, however, there is provided a reading circuit 20 for reading a content of the V-RAM pointer 4, so that a CPU 1 can read the content of the V-RAM pointer 4 through the internal bus 2. The reading circuit 20 may be included in the CPU 1.

Figure 5:
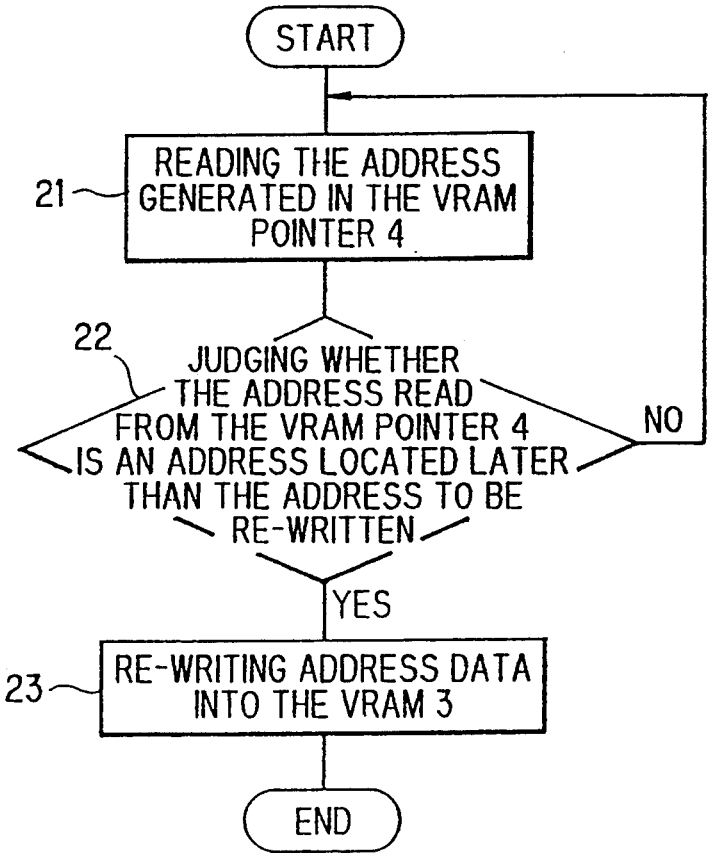
FIG. 5 is a flow chart explaining operation of the video display control circuit in the preferred embodiment according to the invention.

FIG. 5 is a flow chart explaining operation of the video display control circuit in the preferred embodiment according to the invention.

The data reading and transferring operation in the circuit is almost the same as that in the conventional video display control circuit, however, the address to be designated by the V-RAM pointer 4 is read by the reading circuit 20 in each V-RAM accessing operation. In FIG. 5, the reading circuit 20 reads the address in the V-RAM pointer 4 and supplies the address to the CPU 1 through the internal bus 2, at a step 21. The CPU 1 judges whether to start re-writing operation or not in response to the address read from the V-RAM pointer 4 at a step 22. If the address read from the V-RAM pointer 4 is an address located later in access time than the address to be re-written, the re-written operation is carried out at a step 23. If the address read from the V-RAM pointer 4 is an address located earlier in access time than the address to be re-written, then the control of the CPU 1 re-starts from the step 21.

Figure 6A:
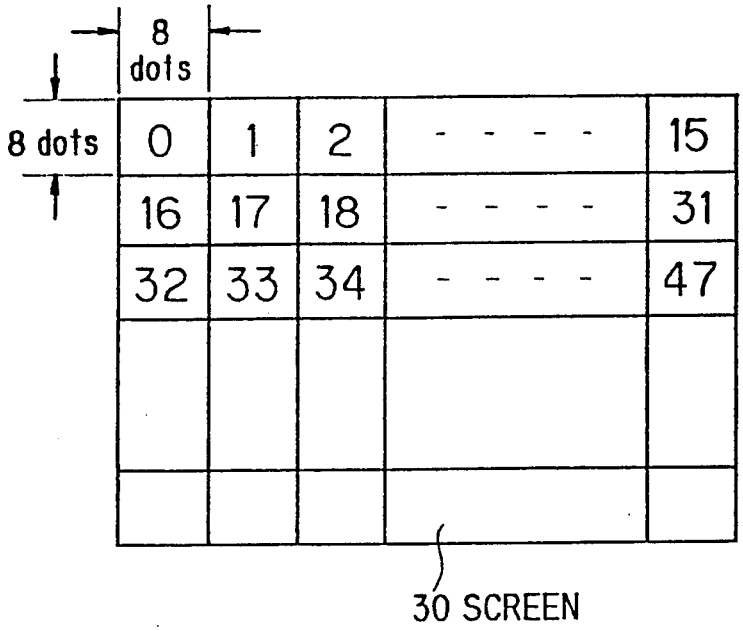
FIGS. 6A to 6C are explanatory diagrams illustrating a relation between a screen and a V-RAM of the video display control circuit in the preferred embodiment according to the invention.
Figure 6B:
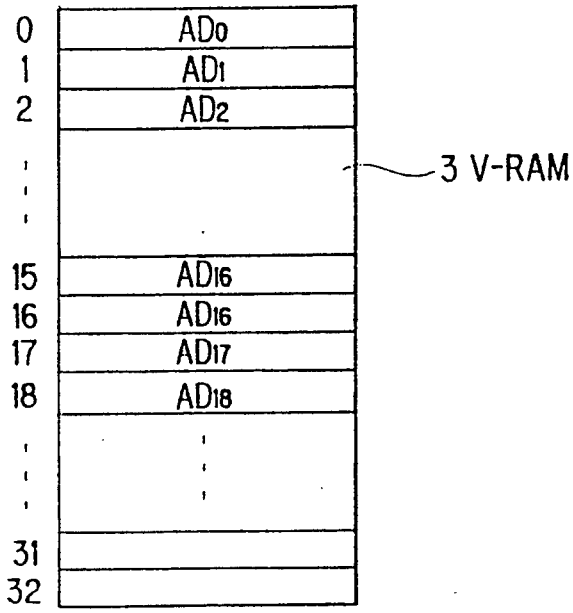

Next, a practical example of displaying characters will be explained in conjunction with FIGS. 6A to 6C. FIGS. 6A and 6B are explanatory diagrams illustrating a relation between a screen 30 and a V-RAM 3 of the video display control circuit in the preferred embodiment according to the invention. In the screen 30, horizontal scanning lines are scanned from left to right repeatedly. More precisely, the screen 30 is composed of 16 character areas 0, 1, 2 . . . 15 for a first row, 16, 17, 18 . . . 31 for a second row, . . . such that each character area is composed of, for instance, 8×8 dots. The V-RAM 3 is provided with storing regions which are equal in number to the screen 30 and have addresses 0, 1, 2, . . . corresponding to the character areas of the screen 30. In this V-RAM 3, starting addresses $AD_0$, $AD_1$ and $AD_2$ of the C-ROM 6 (FIG. 4) for character "A", "B", and "C" are stored a t the addresses 0, 1 and 2, and starting addresses $AD_{16}$, $AD_{17}$ and $AD_{18}$ of the C-ROM 6 for characters "D", "E" and "F" are stored at the addresses 16, 17 and 18. On the other hand, space codes are stored at remaining addresses in the V-RAM 3 for the first and second rows of the screen 30.

Figure 6C:
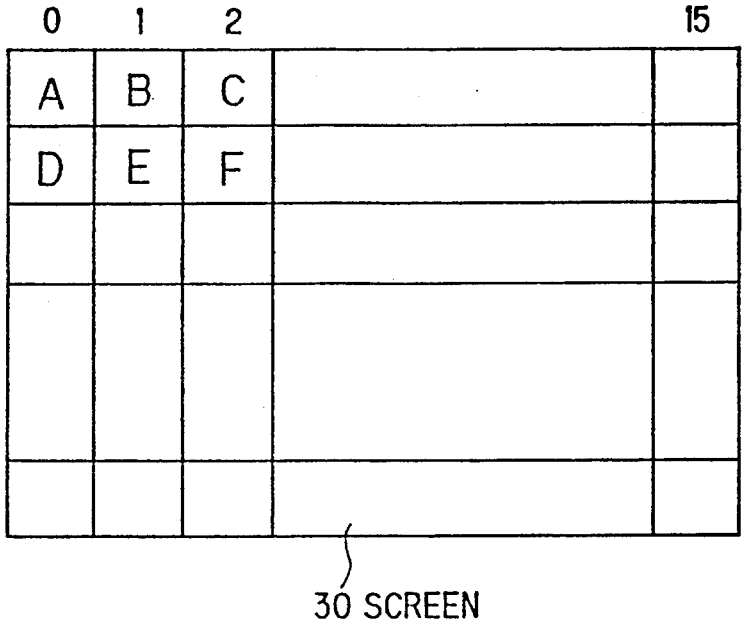

FIG. 6C shows the screen 30 on which the characters "A", "B" and "C" for the first row, and the characters "D", "E" and "F" for the second row are displayed in accordance with the contents of the V-RAM 3 as shown in FIG. 6B.

As described above, each character area of the screen 30 is composed of 833 8 dots, so that each row of the screen 30 is displayed by scanning 8 horizontal lines.

More detailed explanation of operation in the preferred embodiment will be made by reference to FIGS. 4, 5 and 6A to 6C.

At first, the V-RAM pointer 4 designates the address 0 o f the V-RAM 3, so that the starting address $AD_0$ for the character "A" is read from the V-RAM 3 to be supplied to the C-ROM pointer 5. Then, the C-ROM pointer 5 is increased to generate addresses for the character "A" based on the s tar ting address $AD_0$ by receiving the clock signal 9. In the same manner, the address 1 of the V-RAM 3 is accessed by the V-RAM pointer 4 which is increased by receiving the clock signal 8, so that addresses for the character "B" are generated based on the starting address $AD_1$ by the C-ROM pointer 5. Thus, data for the characters "A", "B" and "C" are read from the C-ROM 6 to be supplied to the display control signal generating circuit 7. Similarly, the space codes are read at the addresses 3 to 15 for the first row of the screen 30 from the V-RAM 3, so that no character data is supplied from the C-ROM 6 to the display control signal generating circuit 7. As a result, the video displays "A", "B" and "C" are realized on the character areas 0, 1 and 2 of the screen 30, while no character is displayed on the character areas 3 to 15 of the screen 30, as shown in FIG. 6C. During the time of displaying the characters "A", "B" and "C" on the character areas 0, 1 and 2 of the screen 30, the content of the V-RAM pointer 4 which is increased from 0 to 15 repeatedly for eight times is read to be transferred to the CPU 1 by the reading circuit 20. In the same manner, the characters "D", "E" and "F" are displayed on the character areas 16, 17 and 18 of the screen 30 in accordance with the starting addresses $AD_{16}$, $AD_{17}$ and $AD_{18}$ read from the V-RAM 3. At this time, the content of the V-RAM pointer 4 is 16 to 31. In this situation, the V-RAM addresses presently accessed are addresses later in access time than the addresses 0 to 15 of the V-RAM 3 for the first row, so that the V-RAM 3 may be re-written at the addresses 0 to 15 by new data of starting addresses for the C-ROM 6.

Now, operation in which characters "G", "H" and "I" are displayed in place of the characters "D", "E" and "F" on the second row of the screen 30 will be explained. First, the address data in the V-RAM pointer 4 is read by the reading circuit 20. If the address data thus read corresponds to the third row of the screen 30 below the second row of the screen 30 for the characters "D", "E" and "F", then the rewriting operation is carried out in which the address data of the characters "D", "E" and "F" are erased at the addresses 16, 17 and 18 of the V-RAM 3, and those of the characters "G", "H" and "I" are written at those addresses of the V-RAM 3. At this stage, the address data of up to the second row of the screen 30 have been already read and transferred to the C-ROM pointer 5, so that the re-writing operation of up to the second row of the screen 30 does not affect the display operation to avoid flickering, etc. On the other hand, if the address data read from the V-RAM pointer 4 corresponds to a row of the screen 30 in which address data is required to be re-written, then the re-writing operation will not be carried out, because the re-writing operation affects the display operation to result in flickering, etc.

In this preferred embodiment, when a row of the screen 30 to be re-written by new address data of the C-ROM 6 is a final row of the screen 30, the algorithm defined by the flow chart as shown in FIG. 5 is impossible to be carried out, because an address read by the reading circuit 20 is always earlier in access time than one of addresses corresponding to the final row of the screen 30 in a common video display frame. For this reason, the algorithm should be changed as "when it meets that one of addresses of the V-RAM 3 corresponding to the final row of the screen 30 is separated from one of addresses read by the reading circuit 20, for instance, by at least three rows of the screen 30, the re-writing of new address data of the C-ROM 6 is allowed into one of the addresses of the V-RAM 3 corresponding to the final row of the screen 30." This means that the re-writing of new address data of the C-ROM 6 is allowed into one of addresses of the V-RAM 3 corresponding to any row of the screen 30 under the condition that a time difference is found to avoid the collision between the re-writing of new address data of the C-ROM 6 into a selected address of the V-RAM 3 and the reading of address data of the V-RAM 3.

In the preferred embodiment, although the display of characters on the screen is explained, background is also displayed on an area of the screen excepting the portions of the displayed characters.

Although the invention has been described with respect to specific embodiment for complete and clear disclosure, the appended claims are not to thus limited and alternative constructions that may occur to one skilled in the art which fairly fall within the basic teaching herein set forth.

What is claimed is:

1. A video display control circuit, comprising:

a first memory for storing plural characters at predetermined addresses;

a second memory for temporarily storing addresses of characters to be displayed on a screen;

control means for writing addresses designating characters to be displayed on said screen into said second memory;

a pointer for sequentially supplying read addresses to said second memory and sequentially reading said addresses stored-therein from said read addresses of said second memory;

bus means for transferring said addresses read from said read-addresses of said second memory to said first memory; and reading means connected to said pointer and to said bus, said reading means for reading a read address currently supplied from said pointer to said second memory, to said control means under control of said control means;

wherein characters are sequentially read from said first memory in accordance with said addresses sequentially transferred through said bus means from said second memory, and said read address currently supplied from said pointer is received in said control means by said reading means, whereby characters to be written to a selected address of said second memory are written only when said control means detects that said read address currently supplied from said pointer is subsequent to said selected address of said second memory thereby avoiding any collision between rewritten of said selected address of said second memory and reading of said selected address from said second memory.

2. A video display control circuit, according to claim 1, wherein said reading means is included in said control means.

3. A video display control circuit, according to claim 1, wherein said control means detects when said read address currently supplied from said pointer is subsequent to said write address of said second memory into which the new address is to be written and writing said new address into said write address of said second memory only when said read address currently supplied from said pointer is subsequent to a write address of said second memory into which a new address for said first memory is to be written, thereby avoiding any collision between rewriting of said new address data into said selected address of said video random access memory and reading of said address data from said selected address of said video random access memory.

4. A video display control circuit, comprising:

a central processor unit for controlling operation of said display control circuit;

a character read only memory for storing character data;

a display control signal generating circuit for generating a display control signal in accordance with character data supplied from said character read only memory;

a first pointer supplying said character read only memory with an address designation signal which designates an address where character data to be supplied to said display control signal generating circuit is stored;

a video random access memory for storing address data to be supplied to said character read only memory, said address data in said video random access memory corresponding to characters to be written to predetermined character areas on a display;

a second pointer for supplying said video random access memory with an address designation signal which designates an address where an address data to be supplied to said first pointer is stored; and a reading circuit connected between said second pointer and said central processor unit for reading address data in said second pointer, said central processing unit determining from the read address data whether the address currently being read from the video random access memory is an address located after a selected address to be re-written in said video random access memory and rewriting said video random access memory at said selected address with new address data to be supplied to said character read only memory only when the read address data is an address located after the selected address, thereby avoiding any collision between rewriting of said new address data into said selected address of said video random access memory and reading of said address data from said selected address of said video random access memory.

5. A method of controlling video display control circuit, comprising the steps of:

storing character data in a character read only memory;

temporarily storing address data in a video random access memory to be supplied to said character read only memory, said address data in said video random access memory corresponding to characters to be written to predetermined character areas on a display;

supplying said video random access memory with a first address designation signal which designates an address where address data to be supplied to said character read only memory is temporarily stored;

reading out an address from said video random access memory in response to said first address designation signal;

supplying said character read only memory with a second address designation signal which designates the address read out of said video random access memory where character data to be supplied to a display control signal generating circuit is stored in said character read only memory;

reading out character data from said character read only memory to said display control signal generating circuit in response to said second address designation signal;

reading address data corresponding to said first address designation signal;

determining from the read address data corresponding to said first address designation signal whether the address read from the video random access memory is an address located after a selected address to be re-written in said video random access memory corresponding to a time difference between an address currently being read out of said video random access memory and an address to be later read out;

rewriting said video random access memory at a selected address with new address data to be supplied to said character read only memory only when the read address data corresponding to said first address designation signal is an address located after the selected address, thereby avoiding any collision between rewriting of said new address data into said selected address of said video random access memory and reading of said address data from said selected address of said video random access memory.

* * * * *